US009822521B1

(12) United States Patent
Kuo et al.

(10) Patent No.: US 9,822,521 B1
(45) Date of Patent: Nov. 21, 2017

(54) ASSEMBLY OUTDOOR BALCONY

(71) Applicants: Chingyao Kuo, Luzhou (TW); Norman William Liefke, Surrey (CA)

(72) Inventors: Chingyao Kuo, Luzhou (TW); Norman William Liefke, Surrey (CA)

( * ) Notice: Subject to any disclaimer, the term of this patent is extended or adjusted under 35 U.S.C. 154(b) by 0 days.

(21) Appl. No.: 15/200,106

(22) Filed: Jul. 1, 2016

(51) Int. Cl.

| | |
|---|---|
| ***E04B 1/00*** | (2006.01) |
| ***E04B 1/41*** | (2006.01) |
| ***E04B 5/10*** | (2006.01) |
| *E04B 1/38* | (2006.01) |

(52) U.S. Cl.
CPC ..... *E04B 1/003* (2013.01); *E04B 1/40* (2013.01); *E04B 5/10* (2013.01); *E04B 2001/405* (2013.01); *E04B 2103/06* (2013.01)

(58) Field of Classification Search
CPC ... E04B 1/003; E04B 1/40; E04B 5/10; E04B 2001/405; E04B 2103/06
USPC ..... 52/282.4
See application file for complete search history.

(56) References Cited

U.S. PATENT DOCUMENTS 5,469,678 A * 11/1995 Zamerovsky ..... E04B 1/003 403/217
5,625,987 A * 5/1997 Zamerovsky ..... E04B 1/003 403/217
6,226,941 B1 * 5/2001 Stevens ..... E04B 1/003 52/302.3
6,427,403 B1 * 8/2002 Tambakis ..... E04B 1/003 52/263
8,739,489 B2 * 6/2014 Weber ..... E04F 11/02 256/65.14
9,057,190 B1 * 6/2015 Winter ..... E04F 15/02044
9,567,800 B1 * 2/2017 Newport ..... E06B 9/24
2007/0163205 A1 * 7/2007 Johns ..... E02D 27/01 52/745.05
2008/0005975 A1 * 1/2008 Thompson ..... E04B 1/003 52/62
2014/0190092 A1 * 7/2014 Klassen ..... E04B 1/003 52/79.5
2015/0052845 A1 * 2/2015 Desautels ..... E04C 3/36 52/650.3
2017/0058517 A1 * 3/2017 Mohle ..... E04B 5/48

* cited by examiner

*Primary Examiner* — Charles A Fox
*Assistant Examiner* — James Buckle, Jr.
(74) *Attorney, Agent, or Firm* — Bacon & Thomas, PLLC

(57) ABSTRACT

An assembly outdoor balcony are made up of a plurality of columns, cross beams, beams, adjustable hanging elements, wall-assembled hanging elements and balcony panels, wherein the columns are disposed at interval to form the whole periphery of the balcony; the cross beams can be quickly assembled onto the columns through a beam hanger; the adjustable hanging element allows the joint angle between two beams to be different depending on the environment and needs. All component elements are aluminum alloy materials, which are assembled by mutual engagement. Therefore, the assembly outdoor balcony can be assembled, disassembled and adjusted quickly based on the on-site environment.

7 Claims, 8 Drawing Sheets

ASSEMBLY OUTDOOR BALCONY

BACKGROUND OF THE INVENTION

1. Field of the Invention

The present invention relates to a balcony, particularly to an assembly outdoor balcony which can be quickly assembled and disassembled in accordance with the on-site environment.

2. Description of the Related Art

Currently, an outdoor balcony is usually made up of reinforced concrete, timber or welded steel structures. In general, after the columns are provided, cross beams are disposed at intervals, and then balcony panels are installed. However, the traditional outdoor balcony cannot be altered after the assembly is completed. If a user is not satisfied with the structure or type of assembly, the user can only disassemble the balcony and reassemble it. Besides, the user cannot temporarily change the type of assembly in accordance with the on-site environment or user's needs.

SUMMARY OF THE INVENTION

In view of the foregoing shortcomings related to the traditional fixed outdoor balcony in the prior art, the inventor studied a variety of methods based on manufacturing experiences and skills accumulated, and finally designed and developed the present invention after continuous research, experiments and improvement to eliminate deficiencies and defects in the prior art.

Accordingly, it is an objective of the present invention to provide an assembly outdoor balcony which is formed through aluminum extrusion molding, such that no screw is required for locking during assembly. Thus, it can be assembled and disassembled easily.

It is another objective of the present invention to provide an assembly outdoor balcony, which is formed by mutual engagement of a plurality of columns, cross beams, beams, adjustable hanging element wall-assembled hanging element, and balcony panels. Therefore, the assembly outdoor balcony can be assembled and disassembled quickly.

It is a further objective of the present invention to provide an upright outdoor balcony, in which component elements such as columns, beams, and cross beams can be assembled quickly through a wall assembled element and a beam hanger, and any of two beams can be assembled through an angle adjustable hanging element such that the peripheral shape of the balcony can be adjusted for changes in a variety of angles.

The detailed structure, application principles, functions and effectiveness of the present invention will be apparent with reference to the following description in conjunction with the accompanying drawings.

DETAILED DESCRIPTION OF THE PREFERRED EMBODIMENT

Figure 1:
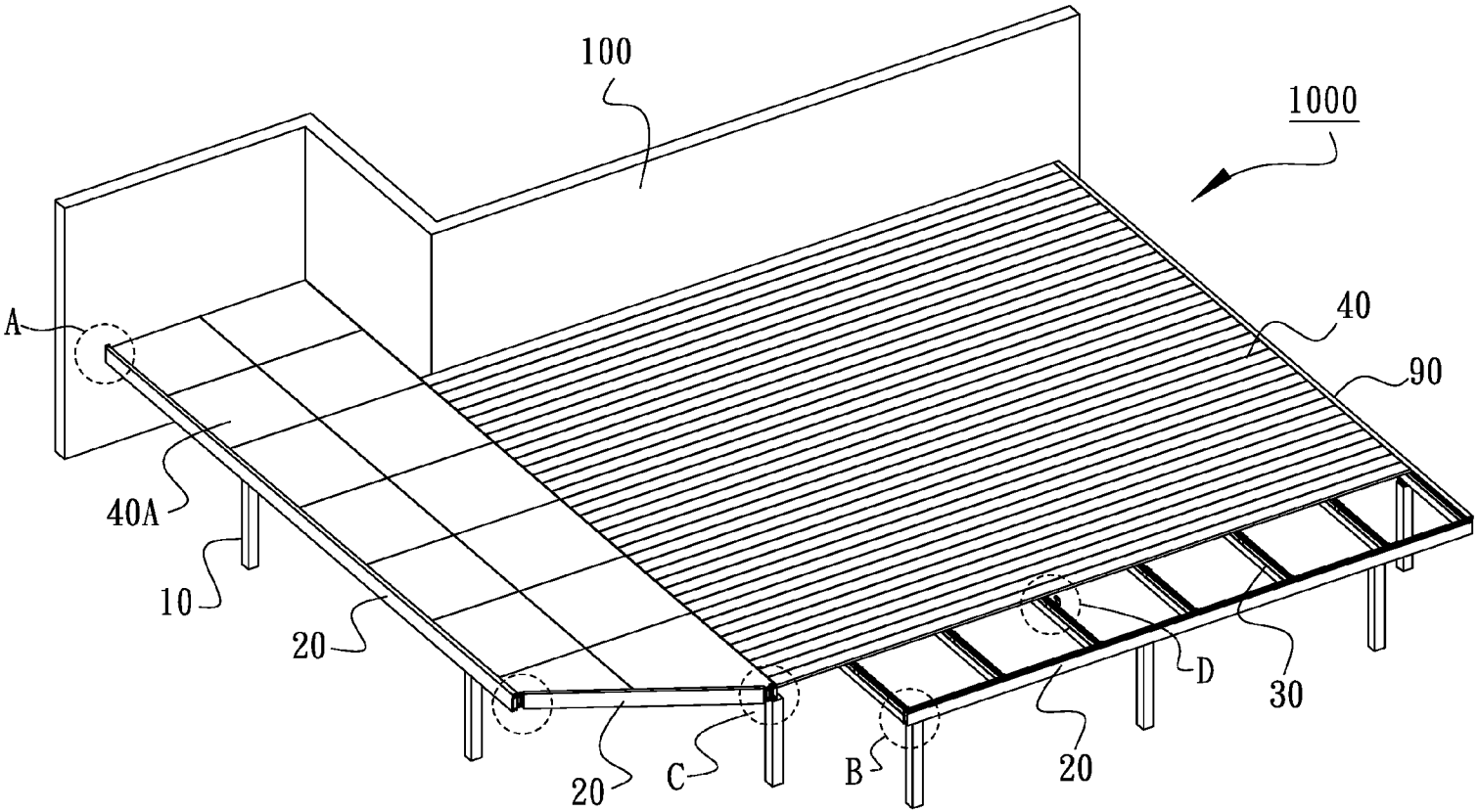
FIG. 1 is an assembled perspective view of the present invention.

In the assembly outdoor balcony of the present invention, as shown in FIG. 1, the outdoor balcony 1000 is formed by assembly of a plurality of columns 10, beams 20, cross beams 30, and balcony panels 40 through aluminum extrusion molding, in which:

The plurality of columns 10 is disposed at intervals on one side of the wall surface 100 to form the whole periphery of the balcony.

The plurality of beams 20 is disposed on the columns 10 to form the whole periphery of the balcony.

The plurality of cross beams 30 are perpendicular to the wall surface 100, and are horizontally disposed at intervals between the beams 20 and the wall surface 100.

The plurality of balcony panels 40 are laid on the cross beams 30. The balcony panels 40 may selectively be translucent balcony panels 40A based on user's needs.

The detailed structure of the assembly outdoor balcony in the present invention will become apparent with reference to the embodiments in conjunction with accompanying drawings.

Figure 2:
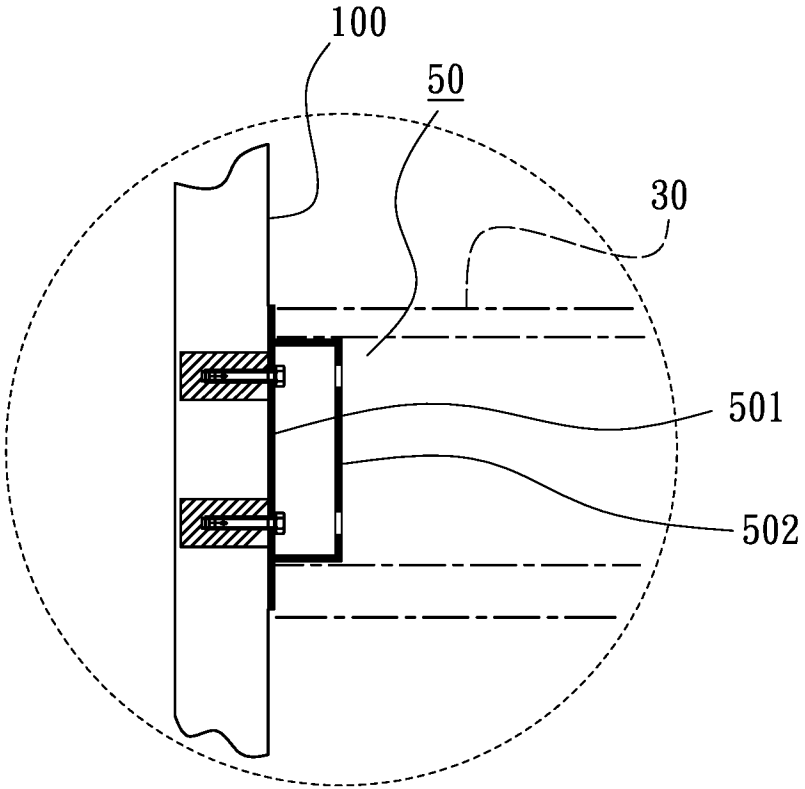
FIG. 2 is a schematic drawing showing the assembly of cross beams and wall-assembled hanging elements in the present invention.

Please refer to section A of FIG. 1 and FIG. 2. As shown, each of the cross beams 30 is a hollow body. An end of the cross beam 30 is hung on the wall surface 100 through a wall-assembled hanging element 50.

The wall-assembled hanging element 50 includes a bottom plate 501 and a rim 502. The bottom plate 501 is fixed to the wall surface 100 through a tool such as a nail. The rim 502 allows an end of the cross beams 30 to sleeve in and stop.

Figure 3:
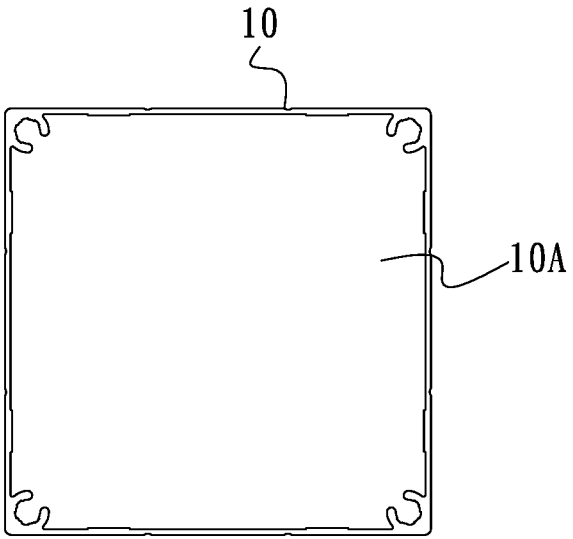
FIG. 3 is a plan view of columns in the present invention.
Figure 4:
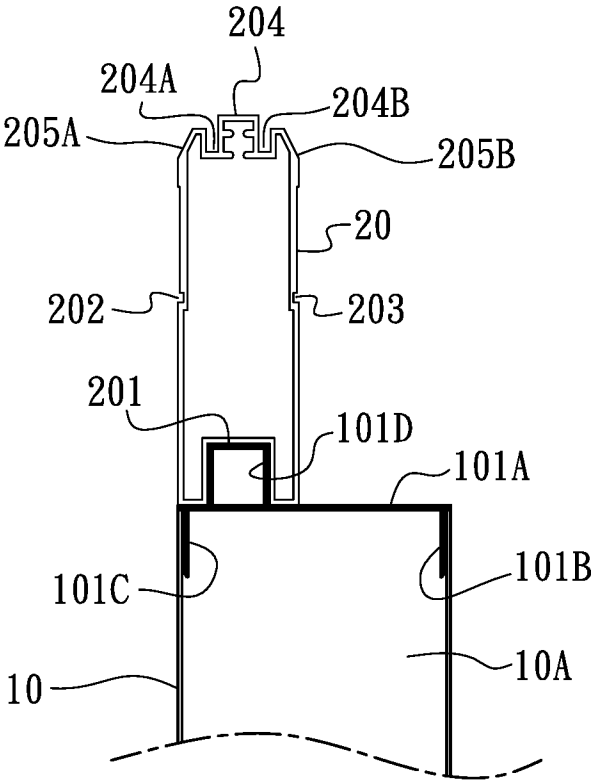
FIG. 4 is a plan view showing the assembly of the columns, beam hanger, and beams in the present invention.

Please also refer to FIGS. 3 and 4. As shown, the columns 10, the beams 20, and the cross beams 30 are all hollow frame bodies processed through aluminum extrusion molding. The columns 10 are hollow square frame bodies, and the beams 20 are vertical hollow frame bodies. A groove 201 is disposed at the lower end of the beams 20, grooves 202 and 203 are disposed on both sides of the beams 20 respectively, and an upwardly protruding portion 204 is disposed at the upper end of the beams 20. Bottom grooves 204A and 204B are formed at the bottom of both sides of the protruding portion 204 respectively. The outside of the bottom groove 204A, 204B is an outer edge portion 205A, 205B with an oblique side having a height lower than the protruding portion 204.

Figure 5:
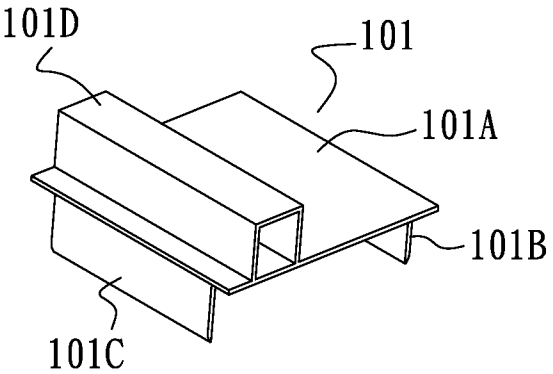
FIG. 5 is a perspective view of the beam hanger in the present invention.

Please also refer to FIG. 5. A beam hanger 101 is disposed above the columns 10 between the beams 20. A bottom plate 101A is disposed on the beam hanger 101. Two upright insert plates 101B and 101C are disposed under the bottom plate 101A. An upwardly protruding seat frame 101D is disposed on one side of the bottom plate 101A. When the insert plate 101B and 101C of the beam hanger 101 are inserted into a hollow section 10A of the column 10, the bottom plate 101A is attached against the upper end surface of the column 10. The groove 201 of the beam 20 is embedded into the upwardly protruding seat frame 101D, such that the beam 20 can be quickly fixed onto the column 10.

Figure 7:
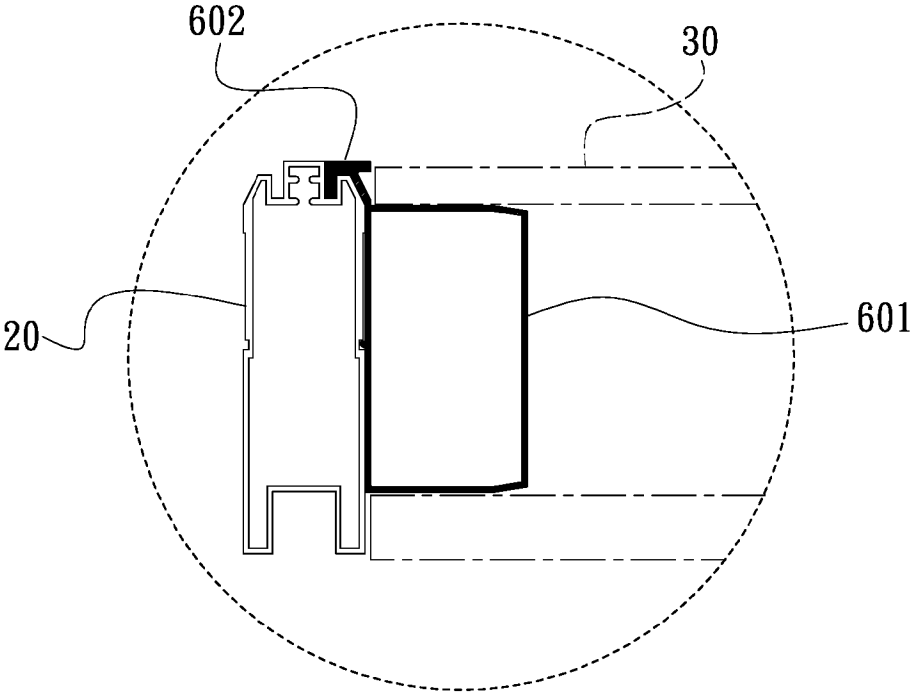
FIG. 7 is a schematic drawing showing the assembly of the beams, engaged hanging element and cross beams in the present invention.
Figure 6:
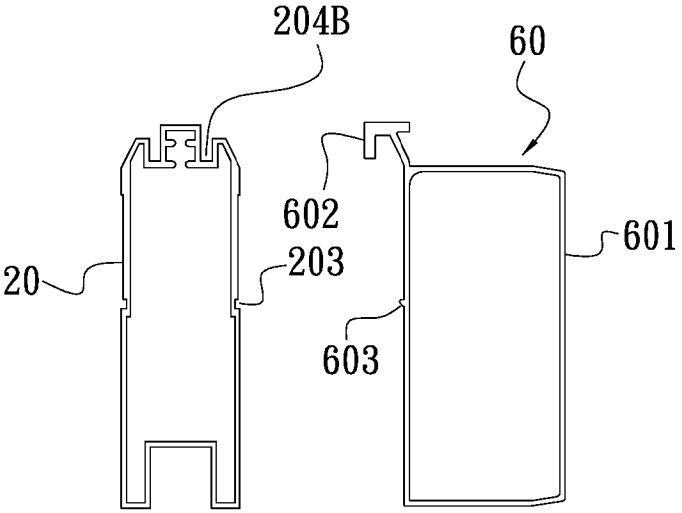
FIG. 6 is a plan view of the beams and engaged hanging element in the present invention.

Please also refer to section B of FIG. 1 and FIGS. 6 and 7. As shown, the beam 20 is assembled to the cross beam 30 through an engaged hanging element 60. A frame body 601 and an upside down portion 602 are disposed in the engaged hanging element 60. The frame body 601 is formed as a hollow aluminum extrusion body. The upside down portion 602 is obliquely and extendedly formed in a corner of the frame body 601. An inverted L-shaped member is formed at an end of the upside down portion 602. Through the upside down portion 602, the engaged hanging element 60 can be inserted into a bottom groove 204B on the beam 20. A protruding rod 603 is disp°Ced up in the bottom groove 204B of the beam 20, the protruding rod 603 is just embedded into the groove 203 of the beam 20, such that the engaged hanging element 60 can be securely hooked up on the side of the beam 20. When the engaged hanging element 60 is hooked up on the beam 20, the frame body 601 allows an end of the cross beam 30 to sleeve in and stop.

Figure 9:
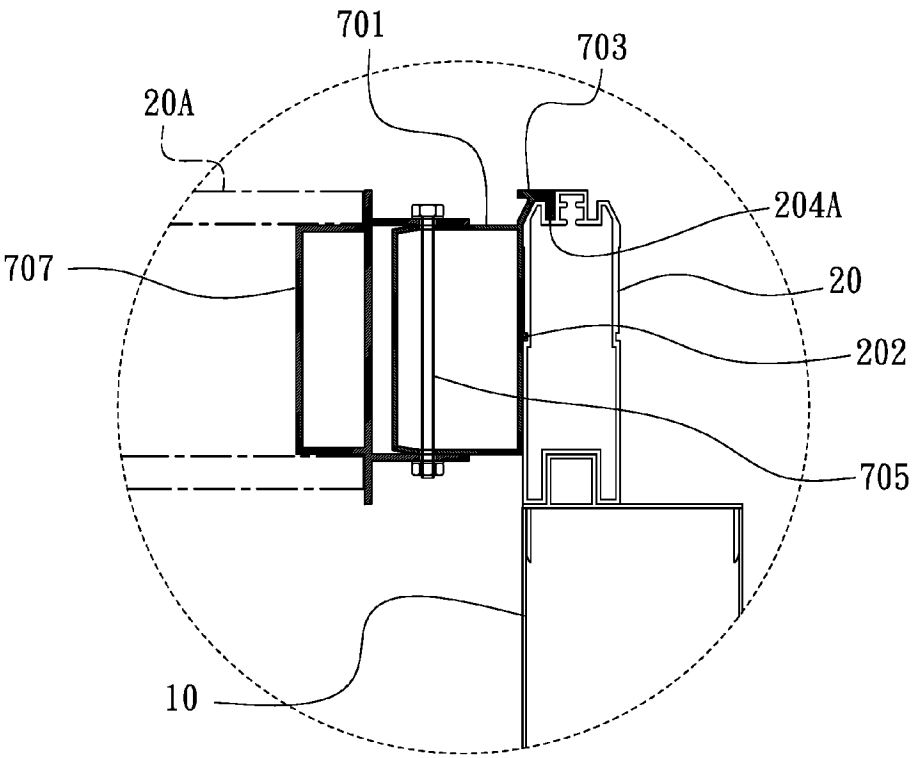
FIG. 9 is a schematic drawing showing the engagement of the beams and the adjustable hanging element in the present invention.
Figure 8:
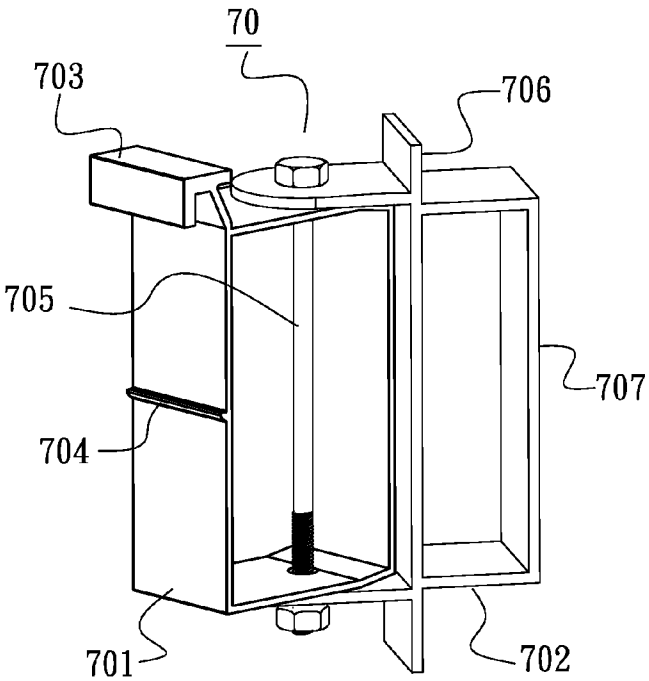
FIG. 8 is a perspective view of an adjustable hanging element in the present invention.
Figure 11:
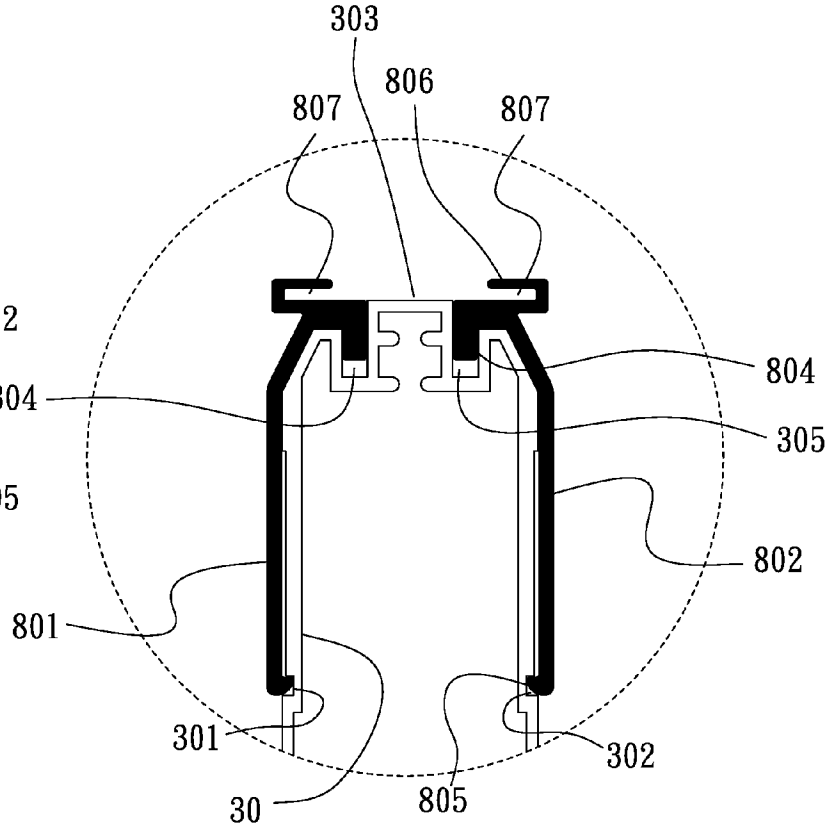
FIG. 11 is a sectional view showing the gusset plates of the balcony panel assembly element assembled to the cross beams according to the present invention.
Figure 10:
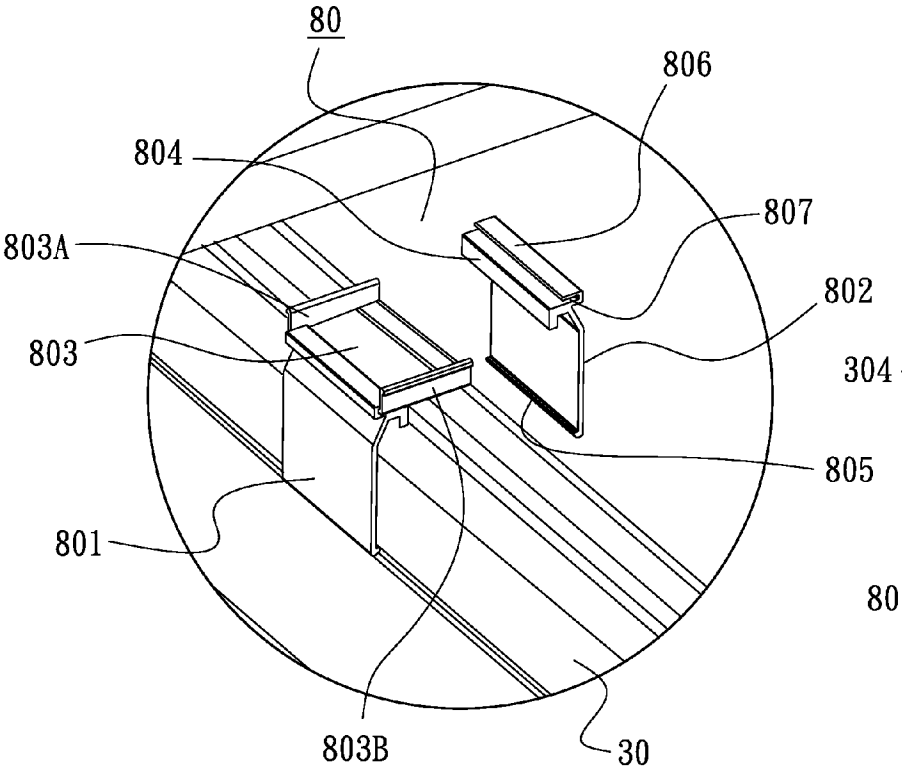
FIG. 10 is an exploded perspective view showing balcony panel assembly element assembled to the cross beams according to the present invention.
Figure 12:
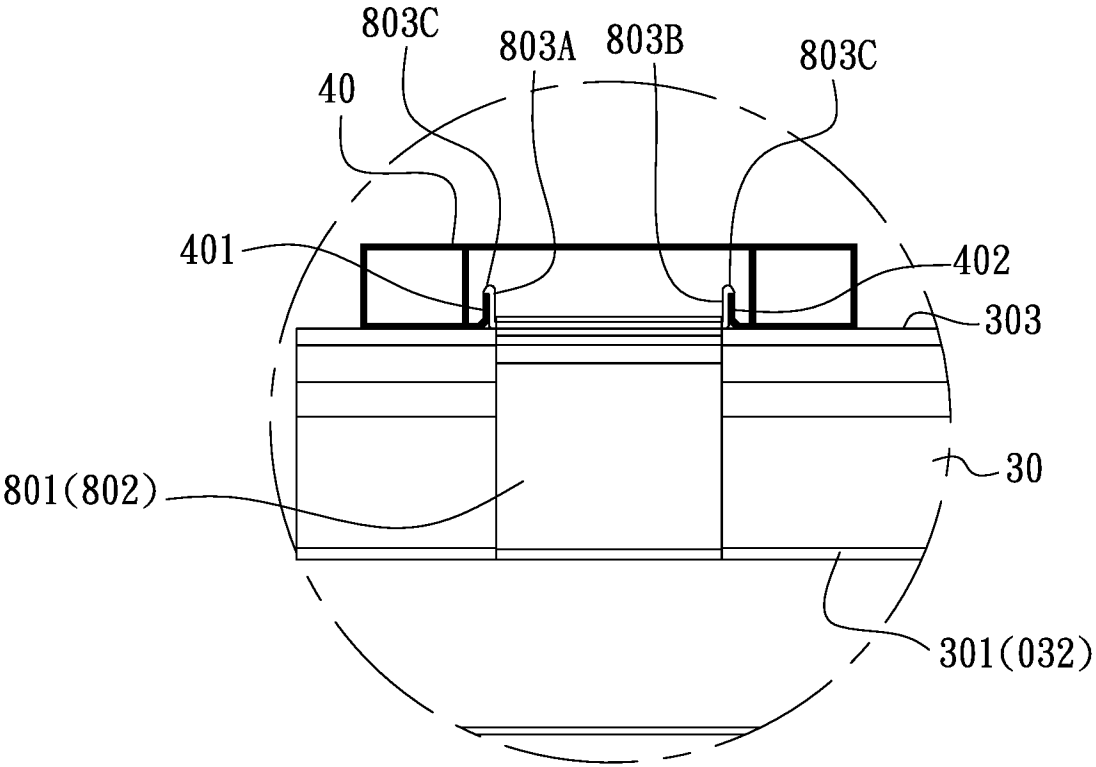
FIG. 12 is a plan view showing the balcony panels assembled to the cross beams according to the present invention.

Please also refer to section C of FIG. 1 and FIGS. 8 and 9. For the assembly outdoor balcony in the present invention, in response to different environments or user's needs, the balcony enclosed frame may be square or polygonal. As shown, an adjustable hanging element 70 is disposed at the junction of the two beams 20 such that the joint angle of the two beams 20 can be adjusted for a variety of changes. The adjustable hanging element 70 includes a fixed portion 701 and a rotating portion 702; an obliquely extended upside down portion 703 is disposed at the upper end corner of the fixed portion 701. An inverted L-shaped member is formed at an end of the upside down portion 703, such that it can be inserted into a bottom groove 204A of the beams 20. A protruding rod 704 is disposed on one side of the adjustable hanging element 70. When the upside down portion 703 is hooked up in the bottom groove 204A of the beam 20, the protruding rod 704 can be embedded into the groove 202 of the beam 20, such that the adjustable hanging element 70 can be securely hooked up on the beam 20.

As shown, the fixed portion 701 of the adjustable hanging element 70 is pivoted to the rotating portion 702 through a pivot 705. The rotating portion 702 can rotate left and right relative to the pivot 705; a partition plate 706 is disposed on one side of the rotating portion 702, and an assembled frame 707 is disposed on the opposite side of the partition plate 706. When the fixed portion 701 of the adjustable hanging element 70 is hooked up on a beam 20, an end of another beam 20A can be sleeved into the assembled frame 707. Thus, the angles between the two beams 20 can be adjusted to different angles.

Please also refer to section D of FIG. 1 and FIGS. 10, 11, and 12. As shown, a plurality of balcony panel assembly elements 80 are disposed on the cross beams 30. The cross beams 30 and the beams 20 look the same. That is, a groove 301, 302 is disposed on both sides of the cross beams 30 as well as both sides of the beams 20. An upwardly projecting protruding portion 303 is disposed at the upper end of the cross beams 30 and the beams 20. A bottom groove 304, 305 is formed at the bottom of both sides of the protruding portion 303 respectively.

The balcony panel assembly element 80 includes two gusset plates 801 and 802 and a base plate 803. The two gusset plates 801 and 802 are identical to each other. An upside down portion 804 is disposed at the upper end of the two gusset plates 801 and 802, and a bottom hook 805 is disposed at the bottom of the two gusset plates 801 and 802. A bent-back folded plate 806 is formed at an end of the upside down portion 803, and a slot 807 is formed inside the folded plate 806. Thereby, the upside down portion 804 of the gusset plates 801 and 802 can be hooked up in the bottom groove 304, 305 of the cross beam 30, and the bottom hook 805 can be hooked up in the groove 301, 302 of the cross beam 30, such that the two gusset plates 801 and 802 can be securely fixed to both sides of the cross beam 30.

The length of the base plate 803 is the same as the width of the gusset plates 801 and 802. As such, when the base plate 803 is inserted into a slot 807 of the two gusset plates 801 and 802, the base plate 803 is clamped fixedly by the gusset plates 801 and 802. This prevents the base plate 803 from sliding back and forth. Vertical plates 803A and 803B are formed at two ends of the base plate 803 respectively. The vertical plates 803A and 803B are perpendicular to the folded plate 806. The height of the vertical plates 803A and 803B is slightly greater than the folded plate 806. Also, an inverted bent portion 803C is formed at top end of the base plate 803;

As shown, two guide plates 401 and 402 which are extending from bottom to top are disposed at the lower end of the balcony panels 40. When the two guide plates 401 and 402 are inserted into the outside of the vertical plates 803A and 803B of the base plate 803, the two guide plates 401 and 402 can be vertically clamped fixedly by the inverted bent portion 803C of the vertical plates 803A and 803B and the protruding portion 303 of the cross beam 30, by which the balcony panels 40 can be tightly fixed to the top of the cross beam 30. Moreover, the position of the base plate 803 is limited by the gusset plates 801 and 802, the sliding and displacement of the balcony panels 40 can be avoided.

Figure 13:
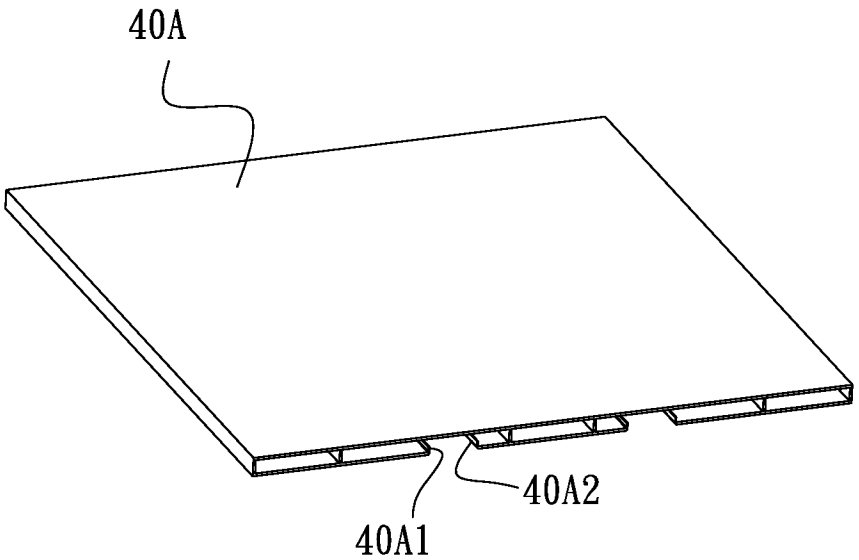
FIG. 13 is a perspective view of translucent balcony panels in the present invention.

As shown in FIG. 13, similarly, two guide plates 40A1 and 40A2 are formed at the lower end of the translucent balcony panel 40A and balcony panels 40. When the two guide plates 40A1 and 40A2 are inserted into the outside of the vertical plates 803A and 803B of the base plate 803, the two guide plates 40A1 and 40A2 can be vertically clamped fixedly by the inverted bent portion 803C of the vertical plates 803A and 803B and the protruding portion 303 of the cross beams 30.

Figure 14:
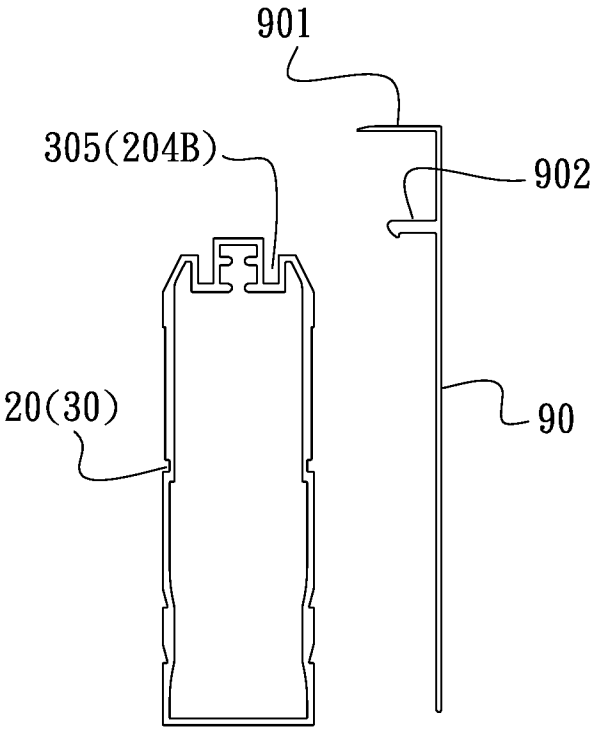
FIG. 14 is a schematic drawing before the sealing plate assembled to the cross beams according to the present invention.

As shown in FIG. 14, when the assembly of the balcony panels 40 is complete, a sealing plate 90 is assembled to the outside of the cross beams 30 or the beams 20 (please also refer to FIG. 1). An upper lateral gusset plate 901 and a lower lateral gusset plate 902 are disposed at intervals at the upper end of the sealing plate 90. The lateral gusset plate 902 is buckled into the bottom groove 305 of the cross beam 30 or the bottom groove 204B of the beam 20, and then the upper lateral gusset plate 901 is pressed against the balcony panel 40, whereby the completely assembled outdoor balcony maintains aesthetics.

Accordingly, the assembly outdoor balcony in the present invention can be assembled and disassembled quickly because the overall elements are assembled through mutual engagement. Through the bottom groove disposed on the beams and the cross beams, the adjustable hanging element 70 and the engaged hanging element 60 can be positioned and fixed quickly; the balcony panels assembly element 80 can also be easily mounted on the cross beams. Also, once the installation position of the balcony panels are confirmed, the balcony panel assembly element 80 can be positioned and fixed quickly, which prevents the balcony panels from sliding due to strong winds after the assembly.

When the present invention is implemented, the length of the balcony panels may selectively be lightweight aluminum panels with the length of 6 feet and the width of 1 foot. The translucent balcony panels may selectively be glass fiber with the length of 3 feet, and the width of 3 feet. Also, since the assembly elements are all made of lightweight aluminum alloy, they are easy to process, compact and easy to install, thereby improving their productivity while reducing the user's installation time.

When the present invention is implemented, the balcony panels and the translucent balcony panels may selectively be made of fiberglass materials with good insulation, heat resistance, anti-corrosion effect, and high mechanical strength.

It should be noted that the described are preferred embodiments, and that changes and modifications may be made to the described embodiments without departing from the scope of the invention as disposed by the appended claims.

What is claimed is:

1. An assembly outdoor balcony, which is made up of a plurality of columns, beams, cross beams, and balcony panels, wherein:

the plurality of columns are disposed at intervals on one side of a wall surface to form the whole periphery of the balcony;

the plurality of beams are disposed above the columns to form the whole periphery of the balcony;

the plurality of cross beams are disposed at intervals between the beams and the wall surface;

the plurality of balcony panels are disposed above the plurality of cross beams;

which is characterized in:

each of the plurality of cross beams is a hollow body having one end hanged to the wall surface through a wall-assembled hanging element and the opposite end jointed to the beam through an engaged hanging element; wherein, the wall-assembled hanging element comprises a bottom plate and a rim, the bottom plate is fixed to the wall surface, and the rim allows an end of each of the plurality of cross beams to sleeve in and stop;

a protruding portion is disposed at the upper end of the beams, and a bottom groove is formed on both sides of the protruding portion respectively;

the engaged hanging element is disposed with a frame body and an upside down portion, the frame body is a hollow body, the upside down portion is formed extendedly and obliquely in the corner end of the frame body, and an end of the upside down portion is formed with an inverted L-shaped member, such that the upside down portion is able to be inserted into a bottom groove on the beams;

when the engaged hanging element is hooked up on the beam, the frame body allows an end of each of the plurality of cross beams to sleeve in and stop;

thereby the plurality of cross beams are easily fixed between the wall surface and the beams through the wall-assembled hanging element and the engaged hanging element.

2. The assembly outdoor balcony as claimed in claim 1, wherein a beam hanger is disposed on the columns, a bottom plate is disposed on the beam hanger, two insert plates are disposed at intervals under the bottom plate, the insert plates are inserted into an interior of each of the plurality of columns, such that the bottom plate is attached against the top of each of the plurality of columns; an upwardly protruding seat frame is disposed on the bottom plate; a groove is disposed at the lower end of each of the plurality of beams, and the groove is embedded into the seat frame of the beam hanger, such that the plurality of beams are fixed securely onto the columns.

3. The assembly outdoor balcony as claimed in claim 1, wherein a groove is disposed on both sides of each of the plurality of beams respectively, and a protruding rod is disposed on one side of the frame body of the engaged hanging element relative to the groove of the respective beam; thereby, when the upside down portion of the engaged hanging element is hooked up in the bottom groove of the respective beam, the protruding rod is embedded into the groove of the respective beam at the same time, such that the engaged hanging element is securely fixed to the side of the respective beam.

4. The assembly outdoor balcony as claimed in claim 1, wherein an adjustable hanging element is disposed at a joint of two beams of the plurality of beams, the adjustable hanging element comprising a fixed portion and a rotating portion; an obliquely extended upside down portion is disposed at the upper end corner of the fixed portion, which is able to be inserted into the bottom groove of one of the plurality of beams through the upside down portion, a protruding rod is disposed on one side of the adjustable hanging element; when the upside down portion is inserted into the bottom groove on the one of the plurality of beams, the protruding rod is embedded into the groove of the one of the plurality of beams, such that the fixed portion of the adjustable hanging element is able to be securely fixed to the side of the one of the plurality of beams; the fixed portion is pivoted to the rotating portion through a pivot, such that the rotating portion is able to rotate relative to the pivot; the rotating portion is disposed with an assembled frame, which allows another beam to sleeve in from one end thereof, such that the joint angles of the two beams jointed by the adjustable hanging element is able to be arbitrarily adjusted.

5. The assembly outdoor balcony as claimed in claim 1, wherein the cross beams and the beams have the same structure, in which a groove is disposed on both sides of the cross beams and the beams respectively, an upwardly protruding portion is disposed at their upper end, and a bottom groove is formed at the bottom of both sides of the protruding portion respectively.

6. The assembly outdoor balcony as claimed in claim 5, wherein the plurality of balcony panel assembly elements are disposed on the plurality of cross beams such that the balcony panels are able to be inserted therein fixedly; wherein, the balcony panel assembly element comprising two gusset plates and a base plate, the two gusset plates are identical to each other, wherein an upside down portion is disposed at the upper end of the two gusset plates, a bottom hook is disposed at the bottom of the two gusset plates, the upside down portion is hooked up in the bottom groove of one of the plurality of cross beams, while the bottom hook is hooked up in the groove of the one of the plurality of cross beams; a bent-back folded plate is formed at an end of the upside down portion of the gusset plate, and a slot is formed inside the folded plate;

the base plate is disposed between two gusset plates, and is clamped by the slot between the two gusset plates, a vertical plate is formed at both ends of the base plate respectively, the vertical plates are perpendicular to the folded plate, an inverted bent portion is formed at the top edge of the vertical plates;

two guide plates which extend from bottom to top are disposed at the lower end of the balcony panels, by which the balcony panels are able to be inserted to the outside of the vertical plates of the base plate, and then through the inverted bent portion of the vertical plates and the protruding portion of one of the plurality of cross beams, the guide plates are vertically clamped securely, such that the balcony panels are able to be securely fixed onto the cross beams.

7. The assembly outdoor balcony as claimed in claim 6, wherein a sealing plate is disposed at the outside of the cross beams or beams, an upper lateral gusset plate and a lower lateral gusset plate are disposed at intervals at the upper end of the sealing plate; the lower lateral gusset plate is buckled into the cross beams or the bottom groove of the beams, and then the upper lateral gusset plate is pressed against the balcony panels, whereby the completely assembled outdoor balcony maintains aesthetics.

* * * * *